US010624472B2

(12) United States Patent
López Fernández

(10) Patent No.: US 10,624,472 B2
(45) Date of Patent: Apr. 21, 2020

(54) OPTIMIZED FOLDING DISPLAY

(71) Applicant: FASTER DISPLAYS LLC, Wilmington, DE (US)

(72) Inventor: Francisco López Fernández, Cornellà de Llobregat Barcelona (ES)

(73) Assignee: FASTER DISPLAYS LLC, Wilmington, DE (US)

( * ) Notice: Subject to any disclaimer, the term of this patent is extended or adjusted under 35 U.S.C. 154(b) by 0 days.

(21) Appl. No.: 15/775,996

(22) PCT Filed: Nov. 24, 2016

(86) PCT No.: PCT/IB2016/057111

§ 371 (c)(1),
(2) Date: May 14, 2018

(87) PCT Pub. No.: WO2017/089989

PCT Pub. Date: Jun. 1, 2017

(65) Prior Publication Data

US 2018/0325287 A1 Nov. 15, 2018

(30) Foreign Application Priority Data

Nov. 25, 2015 (ES) ..... 201531717

(51) Int. Cl.
*A47F 5/11* (2006.01)
*A47B 43/02* (2006.01)
*B65D 5/52* (2006.01)

(52) U.S. Cl.
CPC ..... *A47F 5/116* (2013.01); *A47B 43/02* (2013.01); *B65D 5/5206* (2013.01); *B65D 5/5213* (2013.01)

(58) Field of Classification Search
CPC .... A47F 5/116; A47F 5/11; A47F 5/10; A47F 5/118; A47F 5/0018; A47F 5/0025;
(Continued)

(56) References Cited

U.S. PATENT DOCUMENTS 2,326,493 A * 8/1943 Pringle ..... A47F 5/116 108/101
2,907,452 A * 10/1959 Linder ..... A47B 43/02 206/280

(Continued)

FOREIGN PATENT DOCUMENTS

DE 10 2008 023619 A1 11/2009
DE 20 2008 017213 U1 5/2010

(Continued)

*Primary Examiner* — Patrick D Hawn
(74) *Attorney, Agent, or Firm* — McGlew and Tuttle, P.C.

(57) ABSTRACT

The invention relates to an optimized folding display, comprising two facing main side panels (1, 2), a traverse assembly (3) formed by narrow and elongated rectangular boards of semi-flexible sheet material, and fixing means (11, 12, 13, 14) for keeping the traverses fixed to the outer surface of the corresponding side panel (1, 2). The traverses (3) have their planes separated a given distance, so they form an articulated rhombus which can diagonally be closed from an expanded position into a folded position. Furthermore, the display has at least one shelf element (15) located between the two side panels (1, 2) and resting flat on the traverses (3) located at a similar height, forming a shelving assembly.

11 Claims, 6 Drawing Sheets

(58) Field of Classification Search
CPC ..... A47B 43/02; A47B 43/00; A47B 47/06; A47B 55/06; B65D 5/5206; B65D 5/5213
USPC ..... 211/149
See application file for complete search history.

(56) References Cited

U.S. PATENT DOCUMENTS

| | | | | | |
|---|---|---|---|---|---|
| 3,987,737 | A * | 10/1976 | Smith | A47F 5/116 | 108/179 |
| 4,151,803 | A * | 5/1979 | Ferrera | A47F 5/116 | 108/179 |
| 4,582,003 | A * | 4/1986 | Valero | A47F 5/116 | 108/179 |
| 5,143,230 | A * | 9/1992 | LaCorte | B65H 35/002 | 211/85.28 |
| 5,392,902 | A * | 2/1995 | Vlastakis | A47B 57/00 | 108/165 |
| 5,632,390 | A * | 5/1997 | Podergois | A47F 5/116 | 211/149 |
| 5,669,683 | A * | 9/1997 | Moss | A47B 47/06 | 312/259 |
| 5,702,011 | A * | 12/1997 | Carroll | A47B 47/042 | 108/180 |
| 6,135,033 | A * | 10/2000 | Deferrari | A47F 5/116 | 108/165 |
| 6,715,623 | B2 * | 4/2004 | Broerman | A47F 5/116 | 211/149 |
| 6,752,280 | B2 * | 6/2004 | Dye | A47F 5/116 | 108/162 |
| 7,007,615 | B2 * | 3/2006 | Grueneberg | A47B 43/02 | 108/165 |
| 7,252,200 | B1 * | 8/2007 | Hester | A47F 5/116 | 211/126.16 |
| 8,286,809 | B2 * | 10/2012 | Mestres Armengol | A47F 5/116 | 211/135 |
| 8,944,260 | B2 * | 2/2015 | Hawkins | A47F 5/0025 | 211/135 |
| 9,212,019 | B2 * | 12/2015 | Frost | B65H 45/12 | |
| 9,439,519 | B2 * | 9/2016 | Hawkins | A47F 5/0025 | |
| 9,907,414 | B2 * | 3/2018 | Heuer | A47B 43/00 | |
| 2003/0160015 | A1 * | 8/2003 | Broerman | A47F 5/116 | 211/149 |
| 2004/0211739 | A1 * | 10/2004 | Lembe | A47F 5/0025 | 211/133.1 |
| 2005/0067321 | A1 * | 3/2005 | Pitts | A47F 5/116 | 206/736 |
| 2007/0272639 | A1 * | 11/2007 | Alexander | A47F 5/10 | 211/186 |
| 2009/0140118 | A1 * | 6/2009 | Moss | A47F 5/116 | 248/423 |
| 2013/0098909 | A1 * | 4/2013 | Sitton | A47F 5/118 | 220/4.28 |
| 2013/0109556 | A1 * | 5/2013 | Fischer | A47F 5/116 | 493/324 |
| 2017/0245661 | A1 * | 8/2017 | Heuer | A47B 43/00 | |

FOREIGN PATENT DOCUMENTS

| | | | |
|---|---|---|---|
| DE | 202013100231 | U1 | 2/2013 |
| EP | 2548477 | A2 | 1/2013 |
| ES | 2293784 | A1 | 3/2008 |
| ES | 2379334 | A1 | 4/2012 |
| ES | 1 076 923 | U | 5/2012 |
| ES | 1110005 | U | 5/2014 |
| FR | 2984705 | A3 | 6/2013 |

* cited by examiner

OPTIMIZED FOLDING DISPLAY

FIELD OF THE INVENTION

The present invention relates to an optimized folding display. The display can be used as a commercial product dispenser and is formed by a folding structure built with sheet material, preferably cardboard, or a similar semi-flexible material, which contains or allows housing one or more shelves for displaying the product.

Said display structures are transported in a planar or folded arrangement, and are expanded automatically, semi-automatically or with an easy-to-assemble system at the point of sale or display.

Displays of this type are widely used at the normal points of sale for product samples or set of product samples with usual product weight ranges of up to 50 kg per shelf, and this range varies depending on the materials used and the possible inner reinforcements to be added.

STATE OF THE ART

Different display systems of the mentioned type are known. They generally consist of a base structure and a shelving assembly coupled to the structure, intended for bearing weight.

The most complicated part of displays of this type is the folding system for transporting the display in reduced volume state. This feature represents an important convenience and an important logistic advantage, making it a desirable property to achieve. Therefore, great efforts have been carried out in this sense by a number of developers and inventors to achieve implementations and innovations.

Document ES2379334A1 discloses a self-assembling folding display, made from any lightweight semi-rigid material, preferably cardboard or plastic, for displaying and supporting products intended for sale. The display comprises a body formed by a rear area and two side flaps connected at the front by a lower baseboard. Both in the rear area and at the baseboard there are bellows-like folding lines which are completely straight once the display is unfolded. Furthermore, the display is provided with a plurality of shelves with connecting means for fixing them to one of the sides, leaving the other side supported by gravity in the means provided on the other side. The display can therefore be folded flat with the shelves in it.

Document ES1110005U discloses a folding shelving system obtained from a die-cut and bent sheet that has at least three outer bearing walls resulting from bending a single sheet of sheet material along at least two vertical bending lines. The three walls are capable of keeping the shelving system upright. A set of shelves from parts of the bearing walls results from the die-cutting and bending, the shelves being perpendicular to the bearing walls.

Document ES2293784A1 discloses a display that can be assembled by unfolding consisting of a bottom, sides, aerial shelves, a shelf of the base and an extension piece. The main feature of said display is that it is delivered pre-assembled with its parts suitably adhered to one another. Assembly is done by means of unfolding, bending and putting its components together. Inversely, it can be folded and packaged to be transported to another location.

Document EP2548477A2 discloses a modular folding stand comprising a panel of multiwall structure made of polypropylene. The stand comprises two vertical folds dividing said first panel into a rear plane, a left side plane and a right side plane. The side parts are folded up to 180° towards the rear plane. The rear plane comprises a plurality of horizontal slots and the side parts comprise a plurality of holes corresponding with the plurality of slots. Furthermore, a plurality of rods is provided that can be inserted in the holes of the sides. A plurality of shelves comprising a multiwall structure of polypropylene rests on said rods and comprises flaps inserted in the slots of the rear panel.

Document FR2984705A3 discloses a display made from a semi-rigid material comprising a front panel and a bottom wall connected by two side walls and at least one bearing board. Said display can be folded, where said front part and said bottom wall are arranged against one another.

Document DE 202013100231 U1 discloses a carrier element for supporting shelves or goods carriers in a sales display. The carrier element is formed as a single hollow profile with a support surface and side surfaces. In order to reinforce the hollow profile, a support member for supporting the support surface extends along a plane perpendicular to the support surface center plane and said support member abuts against at least one of the opposite side surfaces.

Although the displays mentioned in the state of the art meet their functional objective, they have not attained the simplification and the performance like that attained by the present invention the features of which are described below.

SUMMARY OF THE INVENTION

The object of the invention is to overcome this drawback. This is achieved by means of an optimized folding display of the type indicated above, characterized in that it comprises:

[a] two facing main side panels arranged parallel at a given distance from one another, made from a rigid sheet material from the group comprising cardboard, wood or the like, each of said side panels having a set of first vertical slots or cuts, the first slots or cuts of one of said two side panels being a symmetrical reflection of the first slots or cuts of the other one of said two side panels, said first slots or cuts of one of said side panels facing said corresponding first slots or cuts of the other one of said two panels;

[b] a traverse assembly formed by narrow and elongated rectangular boards of semi-flexible sheet material divided into

[i] a central region having the same length as said separation distance of said main side panels, and

[ii] at least two end regions that can be articulated by means of creasing lines;

[c] said at least two end regions of each of said traverses correspondingly pass through said first facing slots or cuts of said side panels, said at least two end regions being folded by bending along said creasing lines towards the corresponding outer surface of each of said side panels;

[d] fixing means for fixing said at least two end regions contiguous to said central region of said traverses, from the group comprising glue, staples, fasteners, anchors or the like, for keeping each of said at least two end regions flattened and fixed to the outer surface of the corresponding side panel;

[e] at least two of said traverses have their planes separated a given distance, such that said traverse assembly connected to said corresponding outer surfaces of said side panels form an articulated rhombus which from an expanded position can diagonally be closed into a folded position; and

[f] at least one shelf element located between said two side panels of said display and resting flat on at least two of said traverses located at a similar height, forming a shelving assembly.

The present invention provides a display with a simplified structure that is particularly focused on achieving a significant reduction in handling times during the process of building said display. This advantage is fundamental in terms of production cost reductions, and therefore allows classifying it as a highly competitive product against other displays of its kind.

The combination of system elements implicitly and naturally offers a structure for bearing the shelf element that is highly weight-resistant with respect to other similar displays built with the same materials.

According to another feature of the invention, the optimized folding display further comprises:

[a] side covers covering said outer surface of said side panels and said end regions of said traverses,

[b] said side covers being

[i] fixed to said outer surface of said side panels;

[ii] made from a material from the group comprising cardboard or the like, and

[iii] held by conventional fixing means from the group comprising glue, staples, fasteners, or the like.

According to another feature of the invention, further to said central region and said two contiguous end regions, said traverses comprise two additional end regions, one at each end of said traverses, that can be articulated also by means of creasing lines, and where each of said additional end regions of each of said traverses is inserted through a second slot provided in each of said side panels, again into said side panels, to form a link, said link being used as holding means for the corresponding traverse.

According to another feature of the invention, said display has a plurality of shelving assemblies at different heights, said shelving assemblies being formed by said shelf element and at least two of said traverses.

According to another feature of the invention, said side panels are connected by a rear panel having the same width as that said length of said central region of said traverses, and said side panels being articulated with said rear panel by vertical connecting lines.

According to another feature of the invention, said side panels have a horizontal cutting line at an intermediate height between said shelves, and said rear panel has a creasing line that extends between each of said cutting lines and is aligned with them, forming a lower part and an upper part of said display, said upper part being able to be articulated and bent backwards up to 180° onto said lower part.

According to another feature of the invention, said side covers of said side panels are formed from at least one side prolongation of each of the side panels themselves, said side prolongations being articulated by vertical creasing lines along which they can bend and be folded until covering said at least two end regions of said traverses.

According to another feature of the invention, at least two traverses bearing said shelf element of the shelving assembly are not located at the same height, resulting in said shelf element still having a specific angle of inclination when it rests on said traverses.

According to another feature of the invention, the shelving assemblies of said plurality of shelving assemblies have reduced relative separations and depths according to the height at which they are assembled, giving rise to a display assembly with a stepped configuration.

According to another feature of the invention, the display further comprises an elastic traction system located on the main diagonal of said articulated rhombus, said elastic system generating a force when said display is in the folded position that tends to bring said display to said expanded or working position spontaneously.

Other additional improvements of the invention that have been carried out during the year of priority and that even further improve the performance of the display according to the invention are described below.

According to another feature of the invention, said side panels in which said traverses for bearing said shelf elements are housed, said side covers and said rear panel are formed from a single sheet part having folding lines, such that said two side panels are located at the lateral ends of said sheet part, said rear panel is located in the center and said side covers are in the intermediate areas on either side of said rear panel; and the assembly is folded such that said side panels form the inner walls of the sides of said display, said side panels being articulated by folding lines, located in the front and connected to said side covers, said side covers being articulated by rear folding lines and connected with said rear panel on both sides; and said side panels have pairs of slots the upper ends of which are connected by a cutting line, such that an upside down U-shaped cut remains where pairs of traverses connected at their ends in the form of a rectangular ring through said end regions can be engaged, passing said end regions through said cut.

As a result, once the traverses and shelf elements are placed, the assembly is self-assembling because the side panels are held with the traverses themselves and the shelf elements on the inner face thereof, avoiding other fixing means such as gluing, fasteners, screws or the like. In order to achieve a more compact folding of the assembly the folding lines are preferably vertical.

According to another feature of the invention, the display comprises: two main side panels made from sheet material, each of said side panels having pairs of slots the upper ends of which are connected by a cutting line, such that an upside down U-shaped cut remains; a rear panel connecting said side panels, said side panels being articulated with said rear panel by vertical connecting lines; at least one shelf element having at least two side flaps that can be articulated by means of creasing lines and are configured for being inserted in pairs of slots of said side panels which, in the service position of said display, are facing one another and at one and the same height; side covers covering the outer surface of said side panels and said at least two side flaps; and said side covers being fixed to said outer surface of said side panels, and said side panels in which said at least one shelf element, said main side covers and said rear panel are housed, are formed from a single sheet part having folding lines, such that said two side panels are located at the lateral ends of said sheet part, said rear panel is located in the center and said side covers are in the intermediate areas on either side of said rear panel. As a result, manufacturing and assembly costs are considerably reduced because fewer dies are needed. In a synergistic manner, this configuration allows dispensing with any type of holding means because the display holds in the assembled state merely as a result of the configuration of the sheet part forming the side panels, the rear panel and the side covers. The sheet part is preferably rectangular and the folding lines are preferably vertical.

The display can be built without using glues or attachment elements as a result of a structure of self-consistent assembly, making it the top choice in terms of competitiveness with respect to the displays known in the state of the art.

BRIEF DESCRIPTION OF THE DRAWINGS

To better understand the invention, drawings of embodiments of the present invention are enclosed as non-limiting illustrative examples.

FIG. 3 furthermore indicates possible fixing means for the end regions, such as glue, for example;

EMBODIMENTS

For the sake of simplicity and clarity, most of the drawings show a diagrammatical form of a display without showing specific minor details as they are not considered essential.

Figure 1:
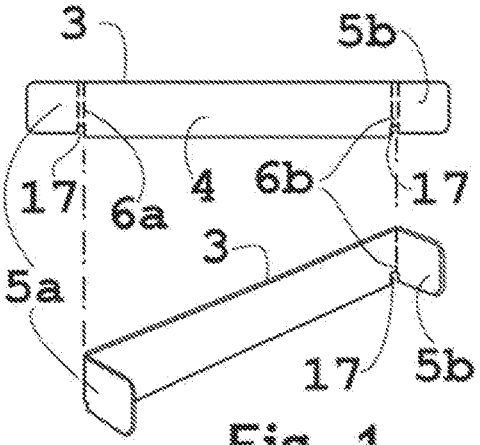
FIG. 1 shows a traverse in its most basic form.

First, FIG. 1 shows a preferred embodiment of the traverse assembly -3- in its most basic form, showing a central region -4-, two end regions -5*a*- and -5*b*-, the creasing lines -6*a*- and -6*b*- along which the different regions can be articulated, and optional slots -17- useful in aiding the fixing means -11-, -12-, -13-, -14- for fixing said end regions -5*a*- and -5*b*- are also indicated.

Figure 2:
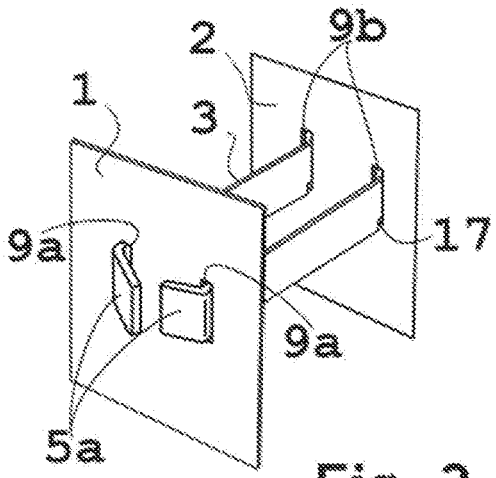
FIGS. 2 and 3 show how a pair of traverses is assembled to the main side panels.
Figure 3:
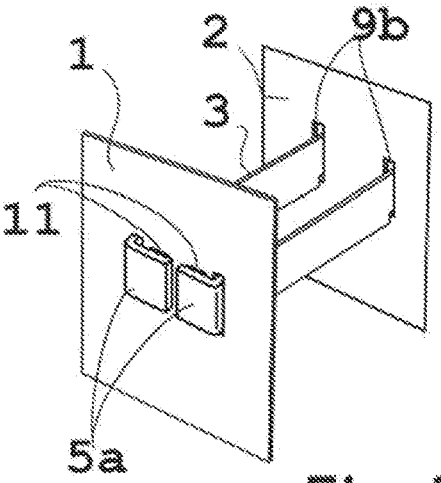

A preferred basic embodiment of the display starts with an assembly such as the one shown in FIGS. 2 and 3. The traverses -3- are assembled to the main side panels -1- and -2-, with their end regions -5*a*- and -5*b*- passing through first slots -9*a*- and -9*b*- provided in the main side panels -1- and -2-. Then they are folded along the creasing lines -6*a*- and -6*b*- and are finally fixed on the outer surface of the panels by fixing means -11-, 12-, -13-, -14- intended for that purpose. A basic display is complete once a shelf element -15- is placed, as will be shown in the following drawings.

Figure 4:
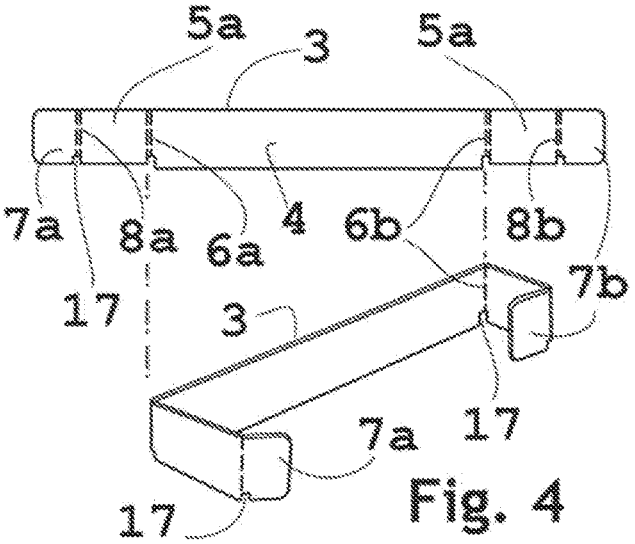
FIG. 4 shows a traverse with two end regions on each side, which are articulated by creasing lines.
Figure 5:
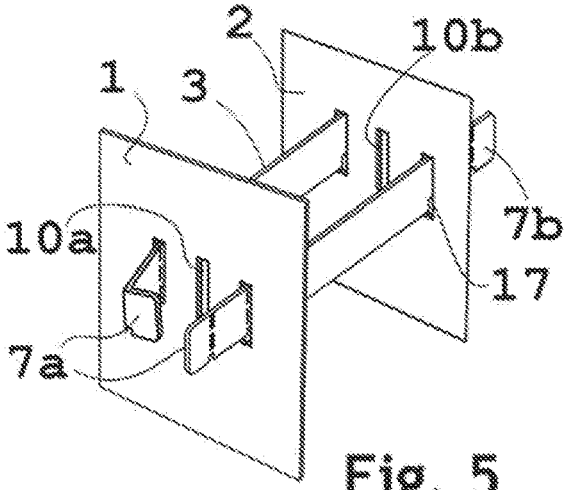
FIGS. 5 and 6 show how the traverses with two end regions according to FIG. 4 are assembled to the main side panels by means of an additional slot provided in said panels.
Figure 6:
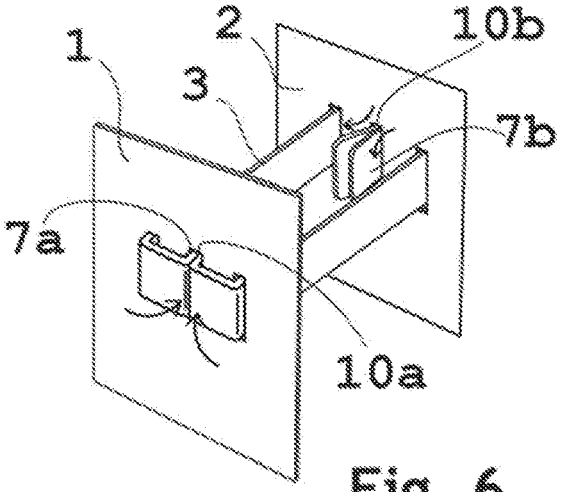

FIG. 4 depicts the embodiment of a traverse -3- with two additional end regions -7*a*- and -7*b*-, and FIGS. 5 and 6 show how said traverses -3- are assembled to the main side panels -1- and -2- by means of an additional second slot -10*a*-, -10*b*- provided in said side panels -1- and -2-. The two additional end regions -7*a*- and -7*b*- of each side of the traverse -3- are inserted through the first slot -9*a*-, -9*b*-. Next they are bent along the creasing lines -8*a*-, -8*b*-, -6*a*- and -6*b*-, and finally the additional end regions -7*a*-, -7*b*- are reinserted therein through the second slots -10*a*-, -10*b*-, said assembly being useful as fixing means for said traverses -3- and their end regions.

Figure 7A:
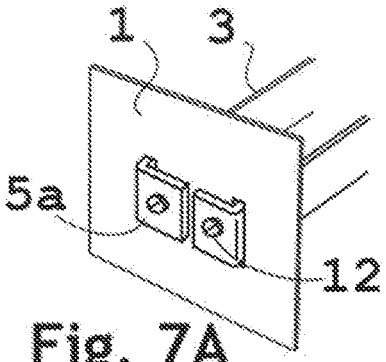
FIGS. 7A, 7B and 7C show ways of fixing the end regions of the traverses to the main side panels.
Figure 7B:
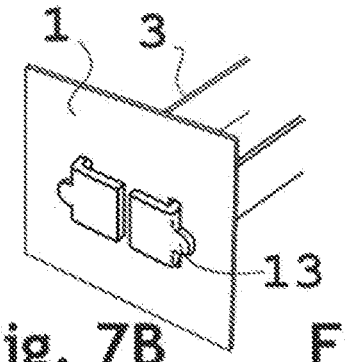
Figure 7C:
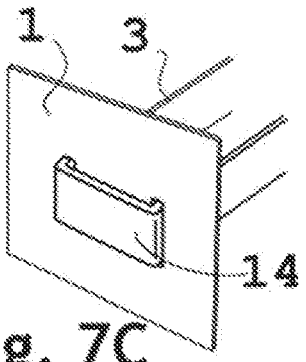

FIGS. 7A, 7B and 7C show preferred embodiments of fixing means for fixing the end regions 5*a*-, -5*b*- of the traverses -3- to the main side panels -1- and -2-. The drawings show a rivet, screw or fastener system -12- in FIG. 7A, a projecting tabs system -13- in FIG. 7B, and a system in which the end regions -5*a*- and -5*b*- are fused into a single region -14- clasping the corresponding side panel -1-, -2- through the two contiguous first slots -9*a*-.

Figure 8A:
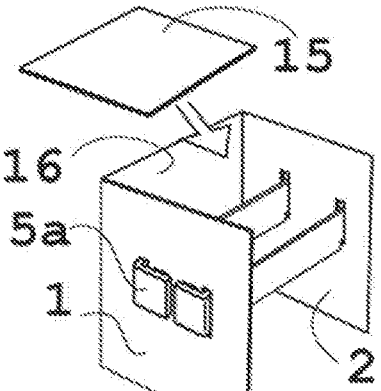
FIGS. 8A and 8B show a display with a rear panel and how to place a shelf element.
Figure 8B:
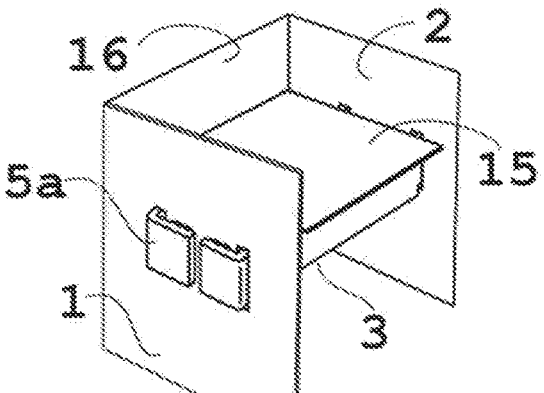

In a preferred embodiment schematically shown in FIGS. 8A and 8B, the display comprises a rear panel -16- connecting the two main side panels -1- and -2-. The rear panel -16- is articulated with them through vertical connecting lines. The drawings further show how to place the shelf element -15-.

Figure 9A:
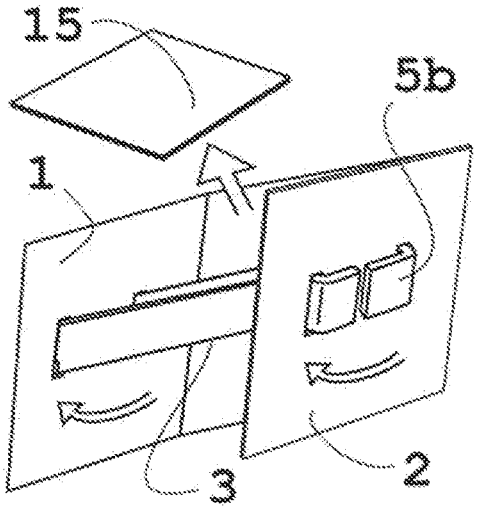
FIGS. 9A, 9B and 9C show how to fold a display by flattening it diagonally.
Figure 9B:
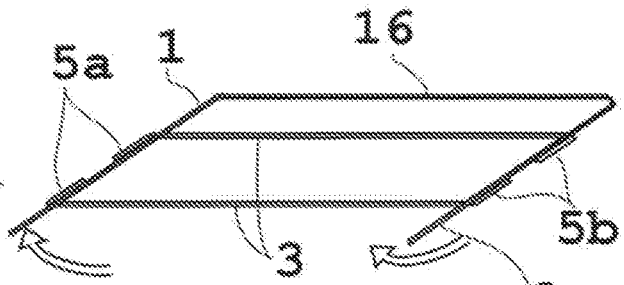
Figure 9C:
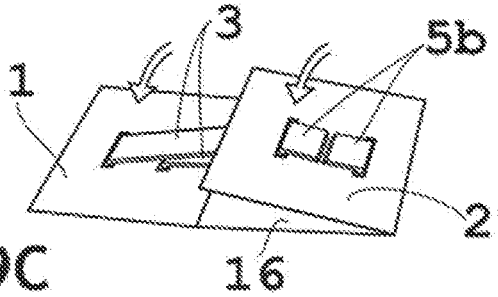

According to another feature of the invention, the described display can be folded until achieving a flattened configuration, and this process is shown in FIGS. 9A, 9B and 9C. As a result of the parallel configuration of the traverses -3-, they can be articulated according to the shape of a rhombus which can diagonally be closed until all the surfaces of the traverses -3- and of the side panels -1- and -2- are finally coplanar.

Figure 10:
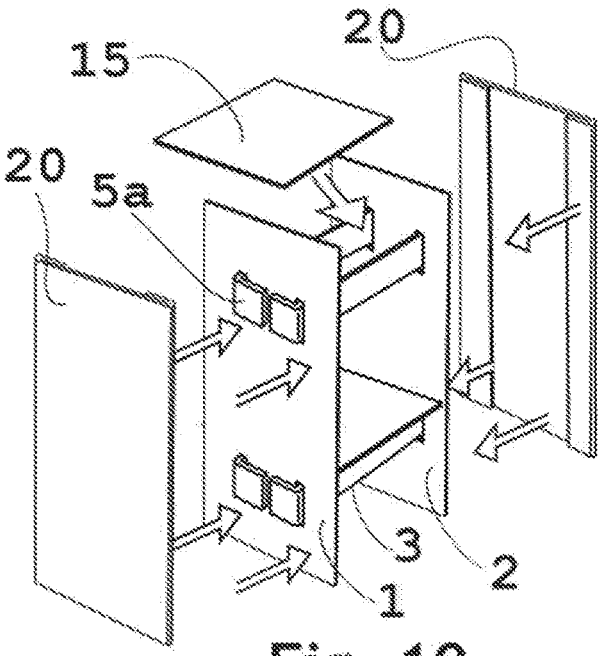
FIGS. 10 and 11 show how to assemble side covers to the display and the final result.
Figure 11:
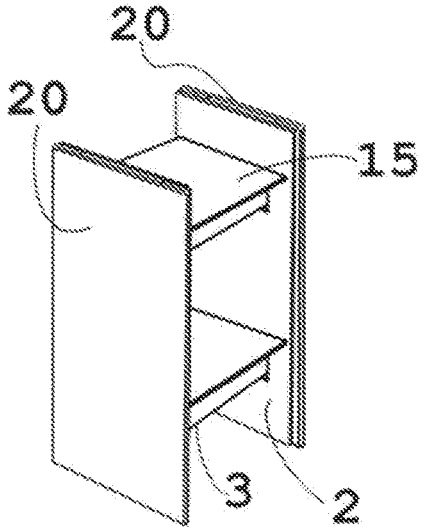

In another preferred embodiment of the invention depicted in FIGS. 10 and 11, further to the traverse assembly -3- and main side panels -1- and -2-, the display comprises side covers -20- fixed against the outer surface of said main side panels -1- and -2-, thereby concealing the back faces and the ends -5*a*- and -5*b*- of the traverses -3-.

Figure 12A:
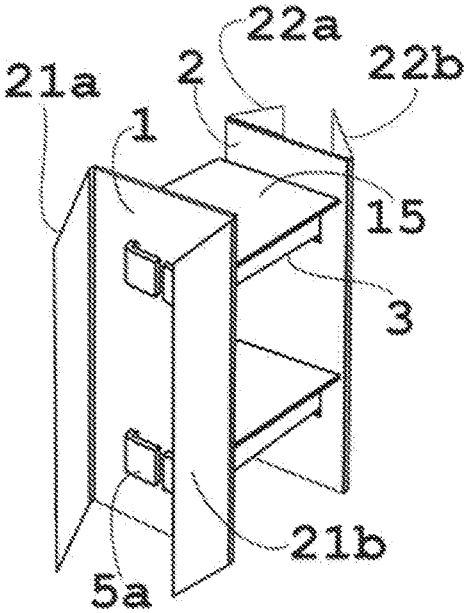
FIGS. 12A, 12B and 13 show examples of side covers formed from extensions of the main side panels themselves.
Figure 12B:
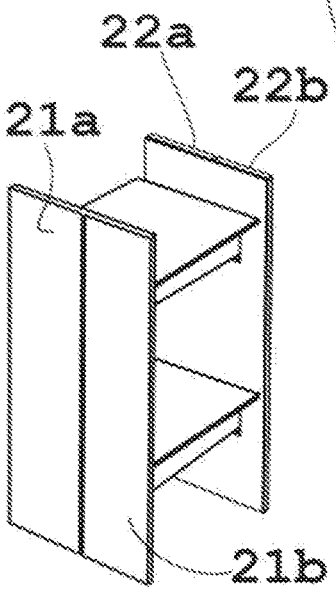
Figure 13:
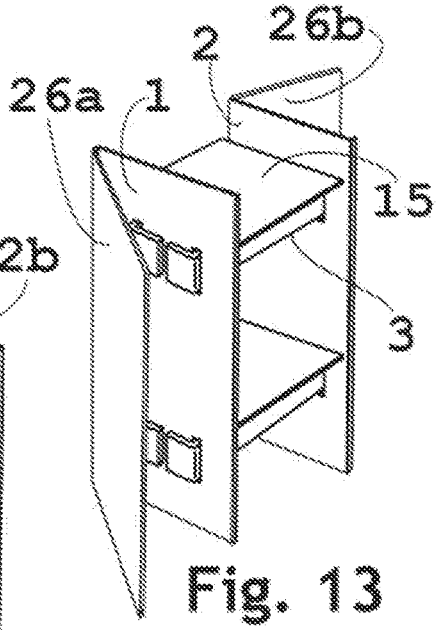

According to another preferred embodiment of the invention, the side covers -20- are formed from extensions or prolongations -21*a*-, -21*b*-, -22*a*-, -22*b*-, -26*a*-, -26*b*- of the main side panels -1- and -2- themselves. FIGS. 12A, 12B and 13 show examples of this embodiment. FIGS. 12A and 12B show two prolongations -21*a*-, -21*b*-, -22*a*-, -22*b*- having about half of the width of the main side panels -1- and -2- and are articulated along connecting lines with same until being closed on the outer surface, leaving an open central line between both prolongations, whereas in FIG. 13 the embodiment consists of a single side prolongation -26*a*-, -26*b*- of each of the main side panels -1- and -2- which folds onto the outer surface of the corresponding panel.

Figure 14:
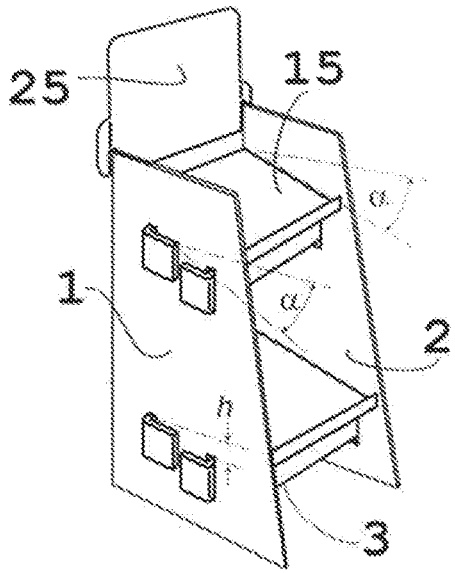
FIG. 14 depicts a display in which the shelves change in depth depending on the height and it also depicts a shelf element with a certain inclination; an optional bracket has also been included.

FIG. 14 shows another preferred embodiment of a display in which the shelves change in depth depending on the height. Furthermore, the display has shelf elements -15- with a certain inclination, which is achieved by placing the traverses -3- on which each of said shelf elements -15- rests at a different height. An optional bracket -25- has also been included in the same embodiment for advertising purposes.

Figure 15:
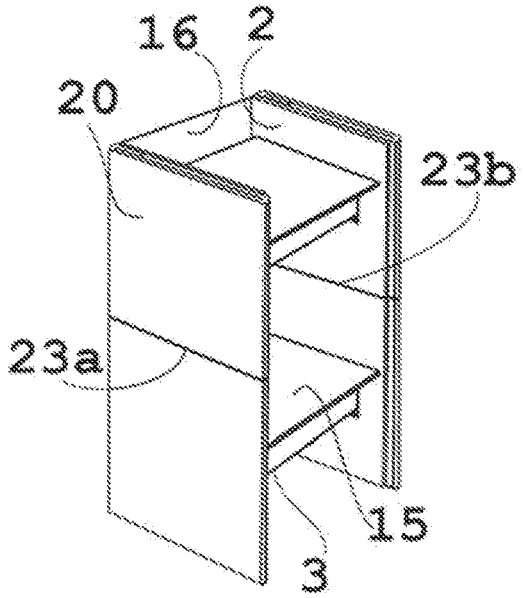
FIGS. 15, 16A and 16B show the possibility of a display with the sides divided by a cutting line, and as a result the assembly can be folded into a twice smaller shape.
Figure 16A:
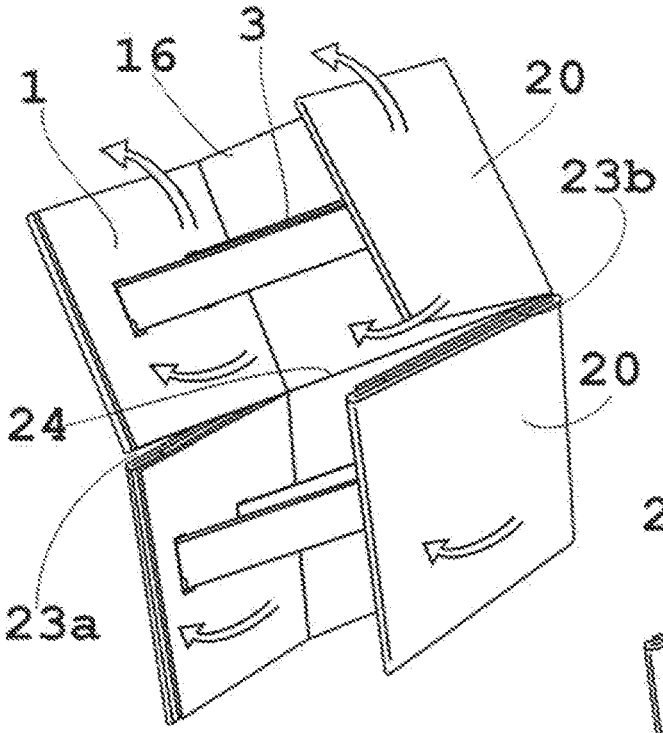
Figure 16B:
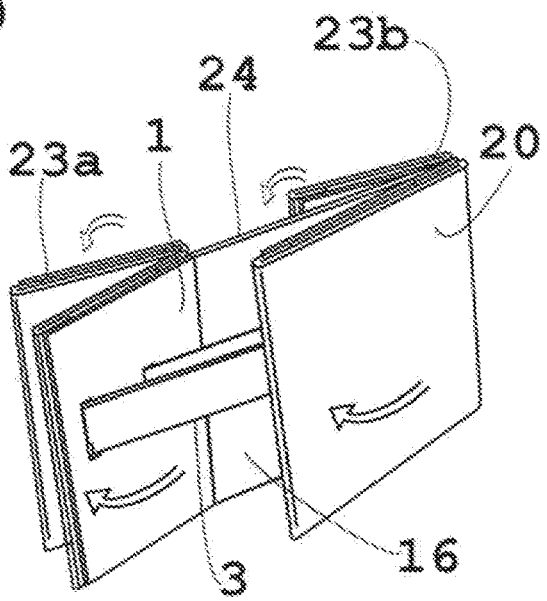

An embodiment based on a display of the type comprising a rear panel -16- like the one described above is also disclosed. Furthermore, the display has a cutting line -23*a*-, -23*b*-, in each of the main side panels -1- and -2-, located approximately between two shelving assemblies. Both lines are located at the same height, and a creasing line -24- in said rear panel -16- extends from a cutting line -23*a*- of one side panel -1- to the cutting line -23*b*- of the other side panel -2-. As a result, the display can be articulated and folded backwards, further to being folded into the characteristic rhombus shape of the invention. Correspondingly, the assembly can be folded into a smaller shape with two-fold size reduction. This embodiment is shown in FIGS. 15, 16A and 16B.

Figure 17A:
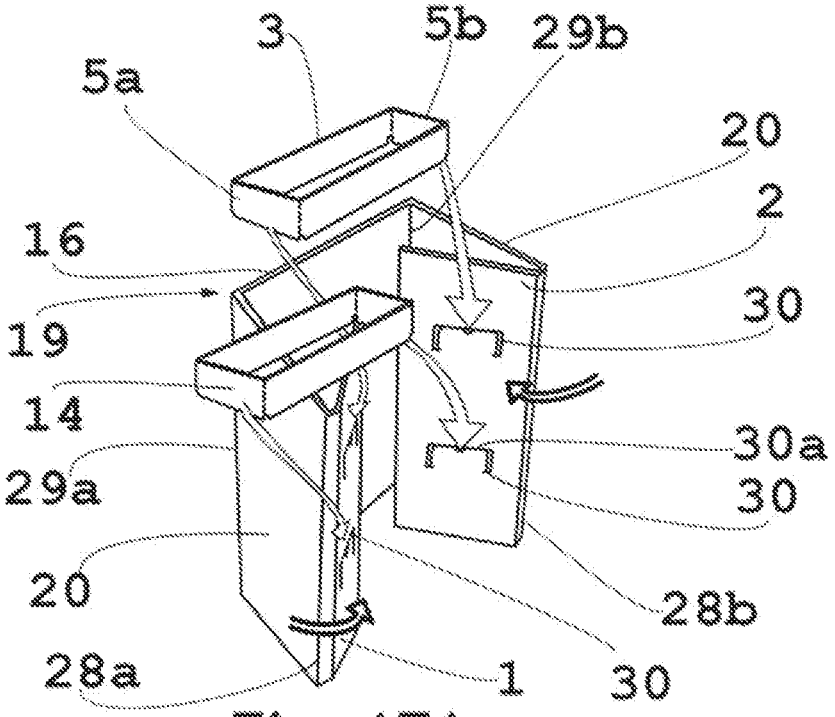
FIGS. 17A and 17B show a display in which the traverse assembly is formed by pairs of traverses connected at their ends in the form of a rectangular ring and how said rectangular ring fits into pairs of upside down U-shaped slots provided on the main side panels.
Figure 17B:
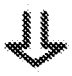

FIGS. 17A and 17B depict another display according to the invention. In this case, the side panels -1-, -2-, the side covers 20 and the rear panel 16 are formed from a single sheet part 19 having vertical folding lines -28*a*-, -28*b*-, -29*a*-, -29*b*-. The sheet part is preferably rectangular, but it could have other shapes, especially in the upper part, to render the display more appealing.

In this display, the two side panels -1-, -2- are located at the lateral ends of the sheet part 19-. In addition, the rear panel -16- is located in the center and the side covers 20- are in the intermediate areas on either side of the rear panel -16-.

This embodiment allows concealing the different panels and technical elements of the display in a simpler manner, and the display can be assembled without requiring additional fixing means. The assembly is therefore folded such that the side panels -1-, -2- form the inner walls of the sides of the display. As seen in the drawings, the side panels -1-, -2- are articulated by preferably vertical folding lines -28*a*-, -28*b*-, located in the front and connected to the side covers -20-. In turn, the side covers -20- are articulated by rear folding lines -29*a*-, 29*b*- and connected with the rear panel -16- on both sides.

Finally, for the purpose of simplifying the assembly of the shelving assemblies and not requiring external fixing elements, the side panels -1-, -2- have pairs of slots -30- the upper ends of which are connected by a cutting line -30*a*-, such that an upside down U-shaped cut remains. Pairs of traverses 3 connected at the ends of the U in the form of a rectangular ring can be engaged through their respective end regions -5*a*-, -5*b*-. To that end, the end regions -5*a*-, -5*b*- are passed through the cut -30*a*-.

Figure 18A:
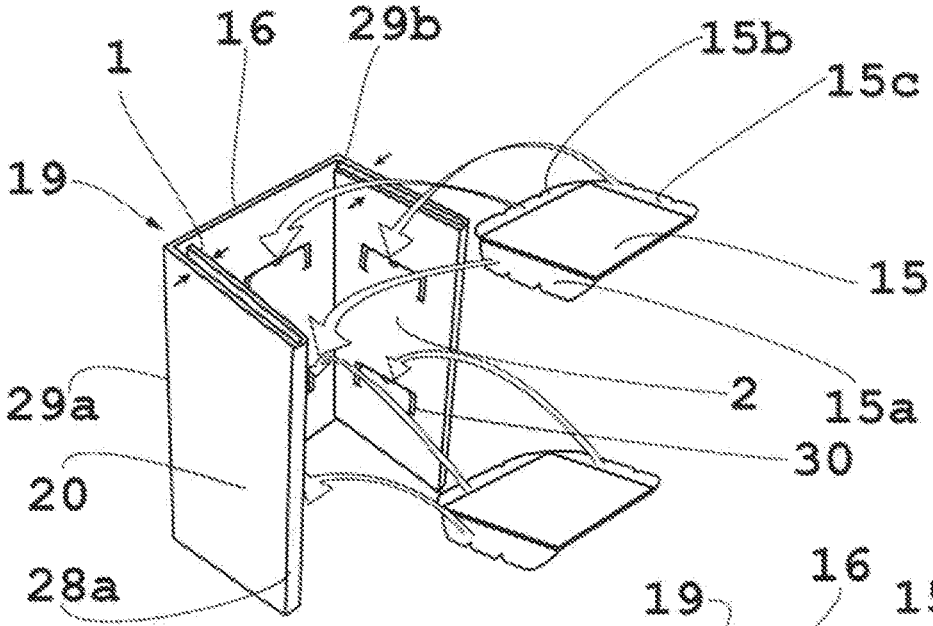
FIGS. 18A and 18B show a display according to the invention in which the shelf element incorporates fixing flaps.
Figure 18B:
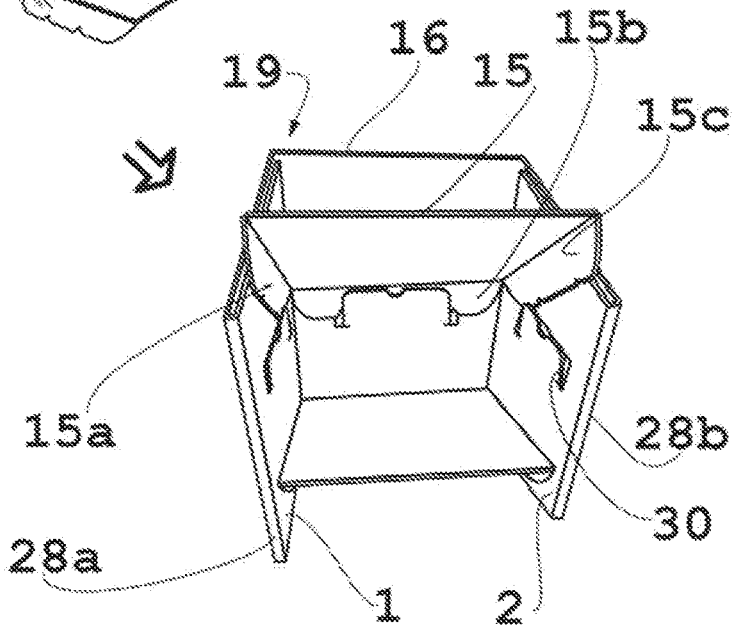

FIGS. 18A and 18B show another embodiment of the folding display according to the invention.

In this case, the display has two main side panels -1-, -2- made from sheet material which, like in the previous embodiment, are provided with pairs of slots -30- the upper ends of which are connected by a cutting line -30*a*- forming an upside down U-shaped cut. Furthermore, the side panels -1-, -2- are connected and articulated with a rear panel -16- by vertical connecting lines.

In addition, the display also has two shelf elements -15- with two side flaps -15*a*-, -15*c*- and a rear flap -15*b*- which are articulated in respective creasing lines. These side flaps -15*a*- -15*c*- are inserted in pairs of slots -30- of the side panels -1-, -2- which, in the service position of the display, are facing one another and at one and the same height, such that it is possible to dispense with the traverses provided in the other embodiments.

Further to the elements that have already been described, in this embodiment the display also has side covers -20- covering the outer surface of the side panels -1-, -2- and the two side flaps -15*a*, 15*c*- of each of the shelf elements -15-. To suitably conceal these elements, the side covers -20- are fixed to the outer surface of the side panels -1-, -2-.

In this embodiment it is particularly preferable for the side panels -1-, -2-, the main side covers -20- and the rear panel -16- to be formed by a single sheet part -19- having vertical folding lines -28*a*-, -28*b*-, -29*a*-, -29*b*-. In this case, the two side panels -1-, -2- are located at the lateral ends of the sheet part -19-, the rear panel -16- is located in the center and the side covers -20- are in the intermediate areas on either side of said rear panel -16-. Preferably, the sheet part -19- is rectangular. Nevertheless, despite the fact that the base must hold on one plane once the display is assembled, the upper end does not necessarily have to be flat. Therefore, this upper end could have other alternative or fanciful shapes.

Figure 19:
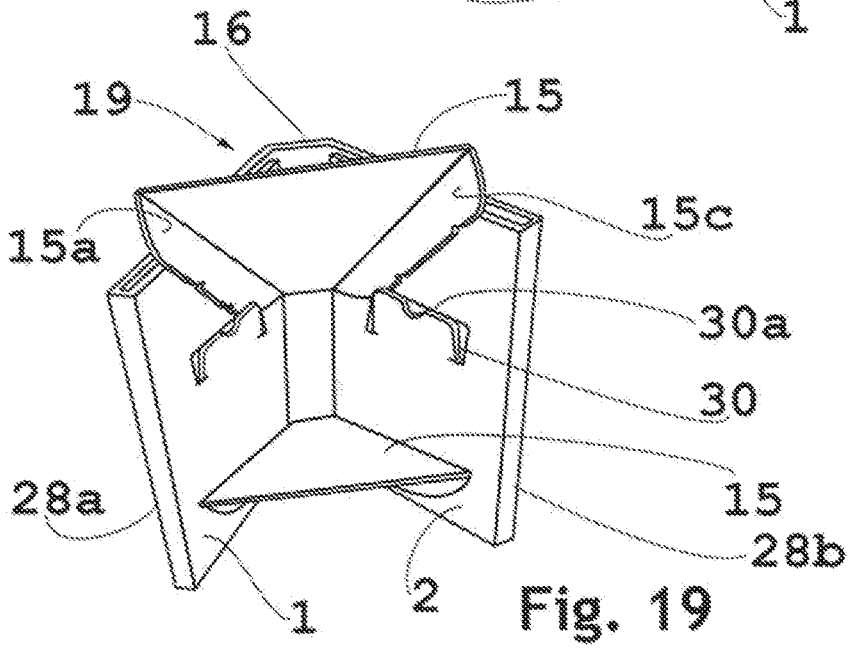
FIG. 19 shows an alternative embodiment of the display of FIGS. 18A and 18B.

FIG. 19 shows an alternative embodiment with respect to FIGS. 18A and 18B in which the side panels -1-, -2- are not parallel. In addition, in this case, the shelf element -15- has two side flaps -15*a*-, -15*c*- but it does not have the rear flap of the previous embodiment.

Figure 17B:
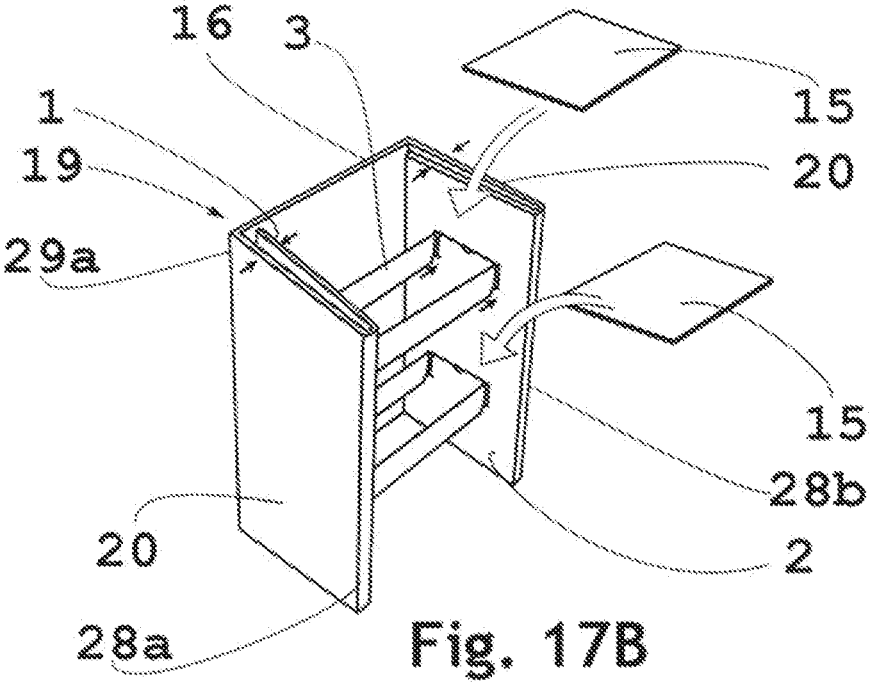

Like in the case of the other embodiments, the sheet material according to the embodiments of FIGS. 17 to 19 is a rigid or semi-rigid sheet material, such as cardboard, plastic, foamboard or equivalents thereof. This sheet material must be rigid enough to hold the weight of the products displayed on the shelves. Furthermore, in those applications in which a panel has to be folded, the material must be flexible.

Although the invention has been described with respect to preferred embodiments, such embodiments must not be considered to be limiting of the invention which is defined by the broadest interpretation of the following claims.

The invention claimed is:

1. An optimized folding display, comprising:

two facing main side panels arranged parallel at a separation distance from one another, the two facing main side panels comprising at least one of cardboard and wood, each of the two facing main side panels having a set of first vertical slots or cuts, the first vertical slots or cuts of one of the two facing main side panels being a symmetrical reflection of the first vertical slots or cuts of another one of the two facing main side panels, the first vertical slots or cuts of one of said two facing main side panels facing the first vertical slots or cuts of the another one of said two facing main side panels;

a plurality of traverse assemblies formed by narrow and elongated rectangular boards of flexible sheet material divided into a central region having a same length as the separation distance of the two facing main side panels, and at least two end regions that can be articulated by creasing lines, the at least two end regions of each traverse assembly correspondingly passing through the first vertical slots or cuts of the two main side panels, the at least two end regions being folded by bending along the creasing lines towards a corresponding outer surface of each of said two facing main side panels;

a fixing means for fixing the at least two end regions contiguous to the central region of a respective traverse assembly, the fixing means comprising at least one of glue, staples, fasteners and anchors for keeping each of the at least two end regions flattened and fixed to the outer surface of a corresponding main side panel, at least two traverse assemblies having planes separated a given distance, such that one of the traverse assemblies connected to the corresponding outer surfaces of the two main facing side panels form an articulated rhombus which from an expanded position can diagonally be closed into a folded position; and at least one shelf element located between the two facing main side panels of the display and resting flat on at least two of the traverse assemblies, forming a shelving assembly.

2. An optimized folding display according to claim 1, further comprising:

side covers covering the outer surface of said two facing main side panels and the end regions of the traverse assemblies, the side covers being fixed to the outer surface of the two facing main side panels, the side covers being formed of a material comprising at least cardboard, and the side covers being held by at least one of glue, and fasteners.

3. An optimized folding display according to claim 1, wherein each of the traverse assemblies comprises two additional end regions, one at each end of the traverse assemblies, the two additional end regions being configured to be articulated by creasing lines, and each of the additional end regions of each of the traverse assemblies being inserted through a second slot provided in each of the two facing main side panels, again into the side panels, to form a link, the link being used as a holding means for a corresponding traverse assembly.

4. An optimized folding display according to claim 1, further comprising another shelf element to provide a plurality of shelving assemblies at different heights, the shelving assemblies being formed by the at least one shelf element and at least two of the traverse assemblies.

5. An optimized folding display according to claim 1, wherein the two facing main side panels are connected by a rear panel having a same width as a length of the central region of at least one of the traverse assemblies, and the two facing main side panels being articulated with the rear panel by vertical connecting lines.

6. An optimized folding display according to claim 5, wherein the side panels have a horizontal cutting line at an intermediate height between shelves, and the rear panel has a creasing line extending between each of the cutting lines and the creasing line is aligned with the cutting lines, forming a lower part and an upper part of the display, the upper part being able to be articulated and bent backwards up to 180° onto the lower part.

7. An optimized folding display according to claim 2, wherein the side covers of the two facing main side panels are formed from at least one side prolongation of each of the two facing main side panels, each side prolongation being articulated by vertical creasing lines along which a respective side prolongation can bend and be folded until covering the at least two end regions of a respective traverse assembly.

8. An optimized folding display according to claim 1, wherein the at least two traverse assemblies bearing the at least one shelf element of a shelving assembly are not located at a same height, resulting in the at least one shelf element having a specific angle of inclination when the at least one shelf element rests on the at least two traverse assemblies.

9. An optimized folding display according to claim 4, wherein the shelving assemblies have reduced relative separations and depths according to a height at which the shelving assemblies are assembled to provide a display assembly with a stepped configuration.

10. An optimized folding display according to claim 2, wherein the two facing main side panels in which the traverse assemblies for bearing shelf elements are housed, the side covers and a rear panel are formed from a single sheet part having folding lines, such that the two facing main side panels are located at lateral ends of the single sheet part, the rear panel being located in the center and the side covers being in the intermediate areas on either side of said rear panel, wherein the assembly is folded such that the two facing main side panels form inner walls of sides of the display, the two facing main side panel being articulated by folding lines, located in front and connected to the side covers, the side covers being articulated by rear folding lines and connected with the rear panel on both sides, the two main facing side panels having pairs of slots, wherein upper ends of the pairs of slots are connected by a cutting line such that an upside down U-shaped cut remains where pairs of traverse assemblies connected at ends thereof in a form of a rectangular ring through the end regions can be engaged, passing the end regions through the cutting line.

11. An optimized folding display, comprising:

two facing main side panels arranged parallel at a separation distance from one another, the two facing main side panels comprising at least one of cardboard and wood, each of the two facing main side panels having a set of first vertical slots or cuts, the first vertical slots or cuts of one of the two facing main side panels being a symmetrical reflection of the first vertical slots or cuts of another one of the two facing main side panels, the first vertical slots or cuts of one of said two facing main side panels facing the first vertical slots or cuts of the another one of said two facing main side panels;

a traverse assembly comprising narrow and elongated rectangular boards of flexible sheet material divided into a central region having a same length as the separation distance of the two facing main side panels, and at least two end regions that can be articulated by creasing lines, the at least two end regions of the traverse assembly correspondingly passing through the first vertical slots or cuts of the two main side panels, the at least two end regions being folded by bending along the creasing lines towards a corresponding outer surface of each of said two facing main side panels;

a fixing means for fixing the at least two end regions contiguous to the central region of a respective traverse assembly, the fixing means comprising at least one of glue, staples, fasteners and anchors for keeping each of the at least two end regions flattened and fixed to the outer surface of a corresponding main side panel, the traverse assembly being connected to the corresponding outer surfaces of the two main facing side panels to form an articulated rhombus which from an expanded position can diagonally be closed into a folded position; and at least one shelf element located between the two facing main side panels of the display and resting on the traverse assembly, forming a shelving assembly.

* * * * *